United States Patent [19]

Harmon

[11] 4,068,607

[45] Jan. 17, 1978

[54] CONTROLLABLE WING SAIL

[76] Inventor: G. Lamar Harmon, 1362 Granville Drive, Winter Park, Fla. 32789

[21] Appl. No.: 722,159

[22] Filed: Sept. 10, 1976

[51] Int. Cl.[2] ..... B63H 9/06

[52] U.S. Cl. ..... 114/102; 114/91

[58] Field of Search ..... 114/102, 103, 90, 91, 114/97, 98, 39; 244/DIG. 1, 35 R, 44

[56] References Cited

U.S. PATENT DOCUMENTS

| | | | |
|---|---|---|---|
| 1,670,936 | 5/1928 | McIntyre et al. | 114/102 |
| 2,077,685 | 4/1937 | Gerhardt | 114/103 |
| 2,126,665 | 8/1938 | Rowland | 114/102 |
| 2,170,914 | 8/1939 | Drummler | 114/39 |
| 2,319,286 | 5/1943 | Andresen | 114/102 |

FOREIGN PATENT DOCUMENTS

| | | | |
|---|---|---|---|
| 1,184,914 | 3/1970 | United Kingdom | 114/102 |

*Primary Examiner*—Trygve M. Blix
*Assistant Examiner*—Charles E. Frankfort
*Attorney, Agent, or Firm*—Macdonald J. Wiggins

[57] ABSTRACT

A sail and rigging arranged to be easily installed on and removed from a hull in which the sail is a wing-like element having a high aspect ratio, and the rigging includes a supporting structure for holding the sail in the position that will provide the maximum propulsive force from an incident wind for the desired point of sailing. The rigging also provides controls for adjusting the angle of attack of the sail with respect to the relative wind; controls for adjusting the angle of the sail with respect to the horizon; and controls for varying the camber of the wing-like sail over local areas of the sail. The controls are operable in combination to produce high forward thrust, a lifting force, and minimum drag from the incident winds which may vary from very light through very heavy, and for all points of sailing. The force from the wind is transferred to the center of lateral effort of the hull and, combined with the lifting action on the wing, essentially eliminates the overturning element present in prior art sails.

3 Claims, 10 Drawing Figures

FIG. 1
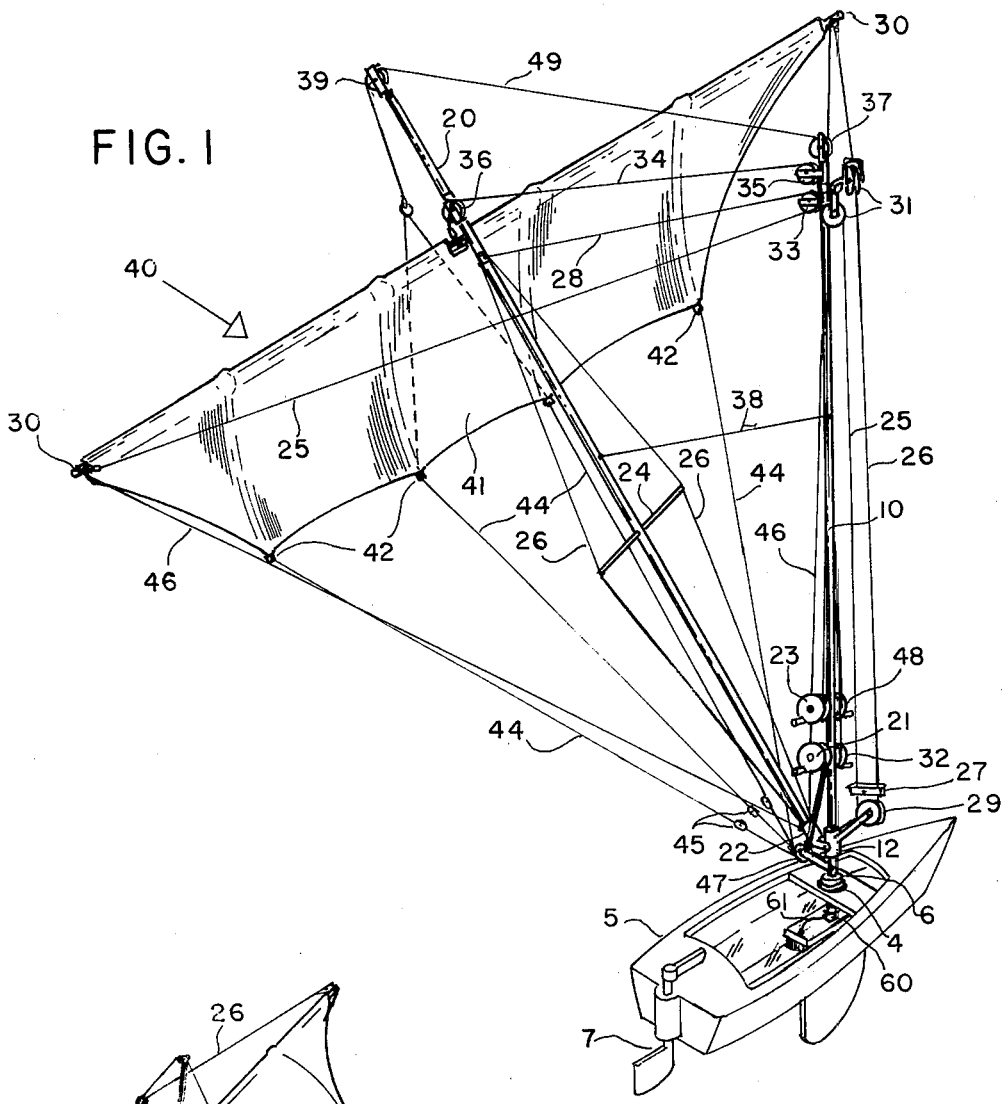
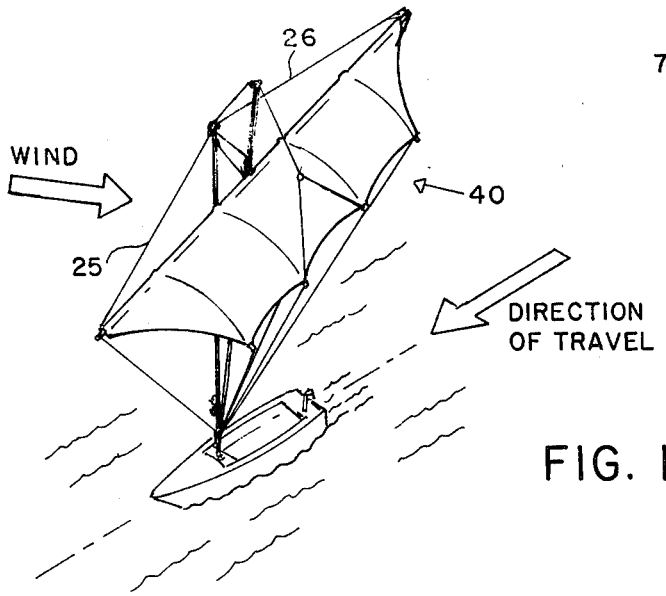
FIG. 1A

FIG. 2
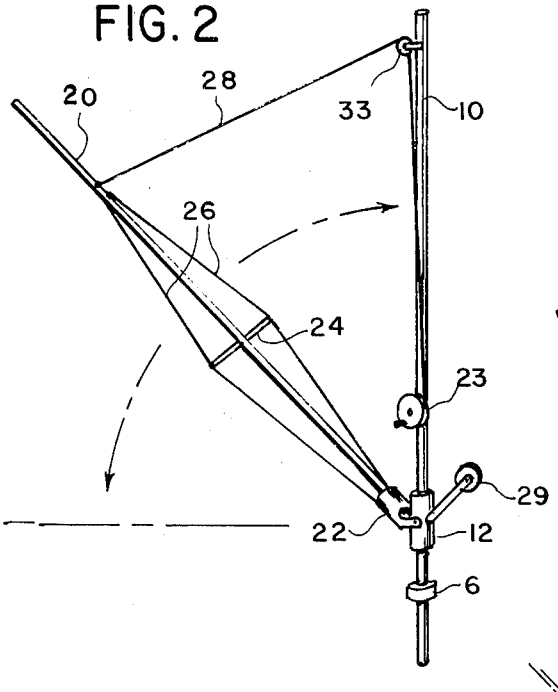
FIG. 5
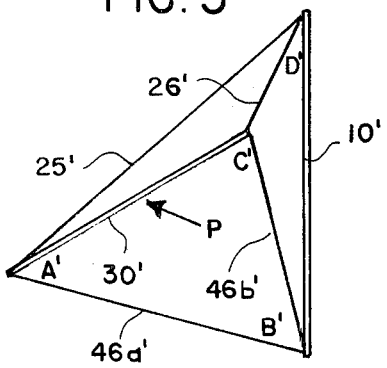
FIG. 3
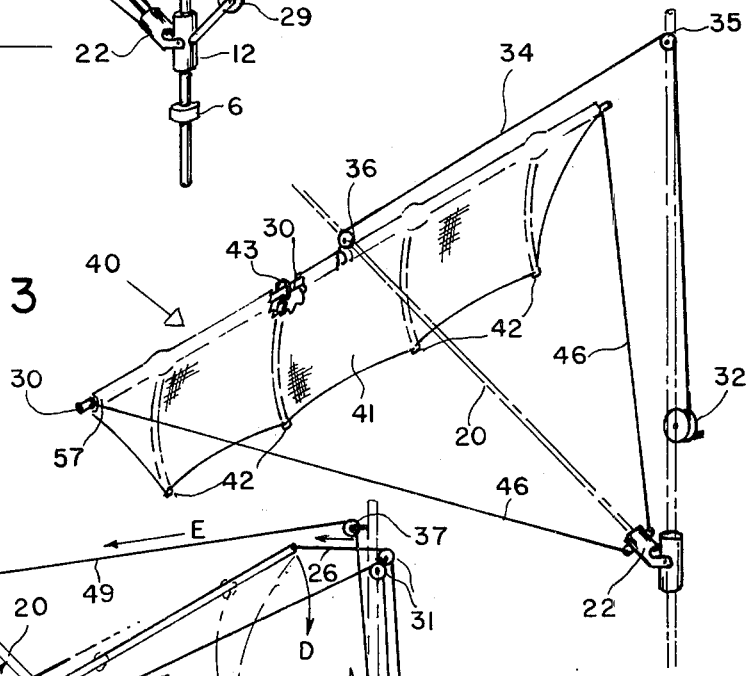
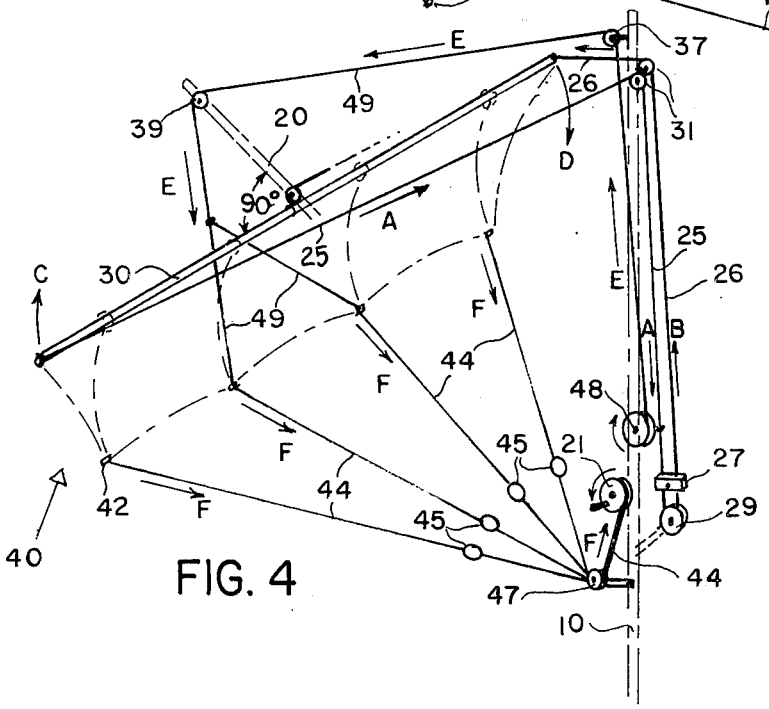
FIG. 4

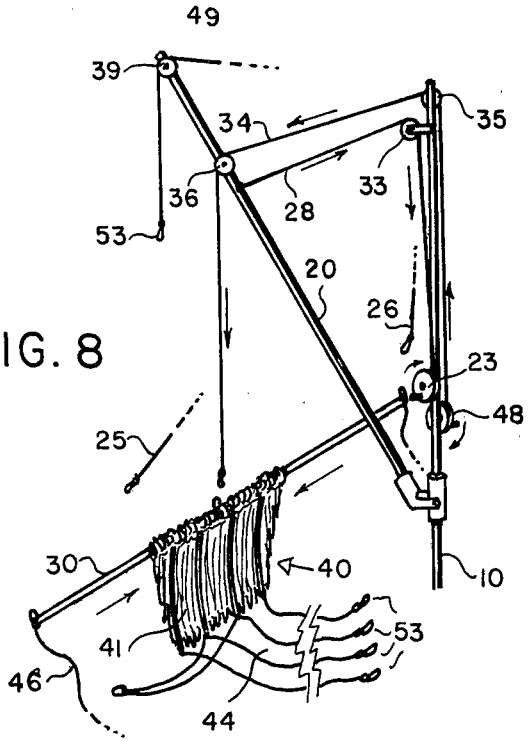
FIG. 8
FIG. 9
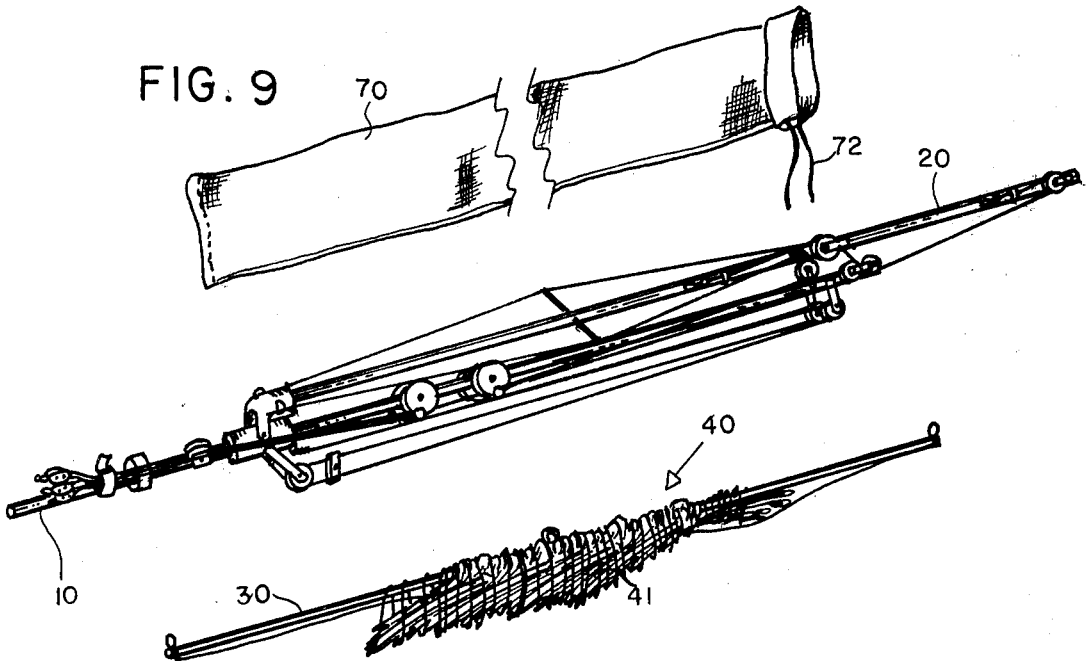

CONTROLLABLE WING SAIL

BACKGROUND OF THE INVENTION

1. Field of the Invention

The present invention relates generally to improvements in sails and rigging for sailing boats, and more particularly to a new, fully controllable, wing-type sail.

2. Description of the Prior Art

Sails and rigging for small sailing boats in the prior art can be divided broadly into two types: the conventional sail that is carried in the plane of a vertical mast with the plane of the sail maintained approximately perpendicular to the surface of the water; and the kite-like sail that is carried with the plane of the sail at an acute angle with the surface of the water. My invention is concerned with improvements on this latter type sail.

The conventional sail is well suited to drive large displacement type boats at speeds below their hull speeds. However, the fundamental problem with the conventional sail is that the driving force of the wind on the vertical sail surface creates an overturning moment which tends to overturn the craft. To resist this moment, several methods are typically used. For example, a large weighted centerboard or heavy ballast in the hull, multiple hulls, and outrigger techniques may be used to provide a righting moment. All of these conventional approaches to stability create additional drag resulting in a reduction of speed of the boat. The overturning propensity of the conventional sail becomes a particularly serious problem when large sails are used on lightweight boats in an attempt to attain high speeds. However, attempts to increase the speed of the craft by increasing the sail area or using very tall high aspect ratio efficient sails have required additional means for counteracting the increased overturning moment, thereby creating additional drag. These constraints therefore limit the speed of conventional sailing boats.

It is clear that planing and other non-displacement hulls together with efficient high lift-to-drag ratio sails are needed if a boat is to attain speeds equal to or greater than the wind velocity. It has been recognized in the prior art that the kite-like sail has the potential to overcome the overturning problem associated with the conventional vertical-plane sail and to provide the needed high lift-to-drag ratio. This type of sail is flown or suspended from a mast or other structure on the craft with its plane maintained at an angle with the water surface. The force of the wind on the kite sail creates a lifting force in addition to a propulsive force. If applied correctly, the lifting force prevents an overturning moment thus eliminating the need for ballast, heavy keels, multiple or wide hulls and the like. A single lightweight hull is sufficient, and high speeds can be obtained.

The kite sails proposed in the prior art generally fall into two classifications. In some designs, solid wing-like structures having fixed cambers are used, and others use more conventional flexible but non-stretchable fabric surfaces cut in such a manner that the camber is created by wind pressure. The basic problem with the kite sail is that of controlling the sail to maintain it in those optimum spatial angles with respect to the relative wind that provide maximum propulsive efficiency. Prior art kite sails using flexible sails and minimal spars and solid members generally depend on the wind to maintain the camber and to hold the sail in the proper position. When the wind subsides, or is light or "flukey", such sails may fall into the water or assume undesirable attitudes. Rigid and/or rigid spar-supported wing sails do not depend upon the wind to maintain their shape; however, such sails often tend to be cumbersome and heavy, and are not easily controlled, lowered, or stowed.

An example of an early version of the non-vertical sail is taught by Ljungstrom, U.S. Pat. No. 612,209. Ljungstrom uses a heavy mast and frame structure to support fabric sails at an angle to the water surface to thereby reduce overturning moments. The adjustments and controls are limited to variants of swinging the sail in pendulum fashion from a yard fastened to the top of a vertical mast. One version requires outrigger pontoons which complicate control problems when changing course. A later U.S. patent to McIntyre et al, No. 1,670,936 shows other techniques to hold the plane of a sail at a desired orientation with respect to the boat. McIntyre proposes both fabric and solid type sails. One disadvantage with the McIntyre fabric sail is that wind pressure is necessary to put a camber into the sail because the sail must be used with the wind first on one side and then on the other. The aerodynamic efficiency of his fabric sail is significantly lowered when the sails are angled out to avoid overturning moments resulting in limiting of the speed potential of the system. His concept of a solid wing sail swung from one side of the boat over the top to the other when tacking partially solves some of these problems; however, methods for handling, stowing, and controlling the undesirable freedom of the sail to revolve about its support spar are not shown.

Rowland, U.S. Pat. No. 2,126,665 uses a sail rigidly supported by side booms in lieu of a mast. The booms are supported by a large turntable used to rotate the structure when it is desired to change the direction of the craft. The Rowland design controls the plane of the sail well but suffers from poor aerodynamic performance with its poor effective aspect ratio. The design lacks flexibility since the turntable and rotating apparatus must be built into the hull. It would not be practical to move the rigging from boat to boat.

It is apparent that the prior art attempts extending over 100 years to provide a practical kite-type sail have not been successful. Except for occasional experimental craft, present-day sailboats continue to use the conventional vertical sail, and the conclusion can be drawn that the full potential of the kite sail has not been realized by any of the known prior art configurations.

SUMMARY OF THE PRESENT INVENTION

The present invention is a wing-like sail with a novel boom, mast, and control arrangement that overcomes the disadvantages of the known prior art kite and wing sail systems. My system not only orients the plane of the sail to avoid an overturning moment but it also goes beyond prior art by controlling the rotational angle of the plane of the sail so the sail attains maximum propulsive efficiency and minimum drag for all boat speeds, points of sailing and wind conditions. Moreover, it provides a rigging that is easily controlled, lowered, dismantled, and changed from hull to hull. In my invention, a high-aspect-ratio collapsible wing-like fabric sail is maintained in a cambered form by a set of curved ribs with the sail mounted on a yard long relative to the sail width. The yard forms the leading edge of the wing-like sail and is suspended at its center from an angularly adjustable boom. The angular orientation of the yard is controllable to maintain the long span of the sail approximately perpendicular to the relative wind to attain maximum lift and minimum drag from the aerodynamically efficient high-aspect-ratio wing-like surface. The angle of attack of the plane of the sail is also controlled to produce the maximum forward thrust for the desired point of sailing. The resultant lift and drag forces caused by the action of the wind on the angled-out and rotated wing-sail propel the boat without an overturning moment, allowing a very large sail area to be employed on a small, light hull. The sail and boom assembly is mounted at the center of lateral effort of the boat, and is free to turn relative to the hull so that the boat can be steered independently of wind and sail forces. The lift and drag forces of the wind on the sail are countered in a kite-like fashion by lines which are attached to the center of lateral effort of the boat near the waterline so that the wind cannot turn the boat over but only propel it forward.

It is therefore a primary object of my invention to provide a wing-like sail to obtain a maximum propulsive force from a wind, regardless of the wind velocity, which only produces a negligible heeling moment on the hull to which it is attached.

It is another object of my invention to provide a high-aspect-ratio wing-like sail in which the attitude of the span of the sail with respect to the relative wind is under positive control to attain an optimum lift-to-drag ratio for all wind conditions.

It is yet another object of my invention to provide a wing-like sail in which the angle of attack of the plane of the sail with respect to the relative wind is under positive control for all wind conditions.

It is still another object of my invention to provide a wing-like sail and rigging that may be installed on a conventional monohull, multihull, or hydrfoil sailing craft and which can replace the conventional mast-sail system on such existing craft.

It is a further object of my invention to provide a wing-like sail and rigging that can be raised or lowered from within the craft on which it is mounted in all wind conditions.

It is a further object of my invention to provide a wing-like sail and rig that is lightweight, and easily stored and transported.

It is yet another object of my invention to provide a wing-like sail having means for trimming the sail to the most effective camber for a particular wind.

It is still a further object of my invention to provide a controllable wing-like sail usable with a lightweight planing hull that can attain high speeds.

These and other objects, advantages, and novel features of my invention will become apparent from the detailed description hereinbelow when considered in conjunction with the drawings.

BRIEF DESCRIPTION OF THE DRAWINGS

FIG. 1 is a perspective view of my controllable wing sail mounted on a monohull showing details of the sail although not necessarily in an operative configuration, FIG. 1-A is a forward view of a sail boat using my sail and in operation, FIG. 2 is a schematic diagram of the sail supporting structure of the sail assembly shown in FIG. 1, FIG. 3 is a schematic diagram of the wing sail element of the sail assembly shown in FIG. 1 illustrating the yard and sail surface, FIG. 4 is a schematic diagram of the control means for providing control of the angular attitude of the yard and the angle of attack of the sail element of FIG. 3, FIG. 5 is a schematic diagram of the tetrahedron formed by the support lines and structure, and the control lines of my controllable wing sail, FIG. 8 is a partial schematic view of my controllable wing sail in the process of being lowered, dismantled, and stowed, and FIG. 9 is a partial view of my controllable wing sail disassembled and secured for stowage, along with a suitable stowage bag.

DETAILED DESCRIPTION OF THE PREFERRED EMBODIMENT

Figure 6:
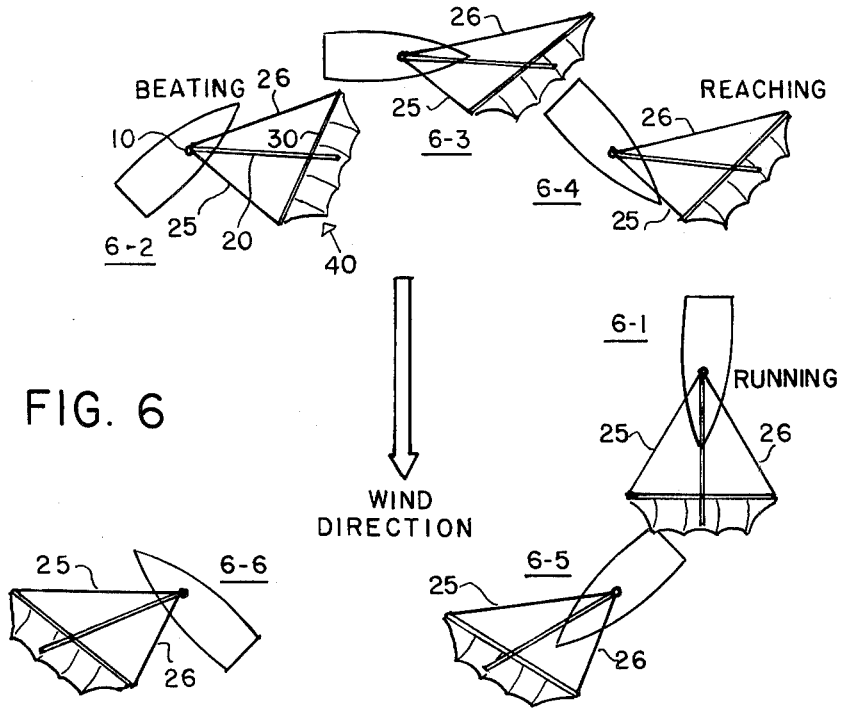
FIG. 6 is a plan view of a sailing craft using my controllable wing sail, with the craft shown in various points of sailing and illustrating a preferred attitude for the sail element.

An overall perspective view of my controllable wing sail is shown in FIG. 1 with the assembly installed on a conventional monohull. In general, the assembly consists of three basic elements: a mast and boom support element; a wing-like sail element; and a group of control lines and controls. The elements are illustrated separately in FIGS. 2, 3, and 4 in isolated views to more clearly indicate the function of the various components.

Turning first to FIG. 2, the mast and boom support element is shown isolated from the other elements of my sail. A mast 10 is shown having a collar 6 affixed to its lower end and a short distance above the collar 6 a sleeve 12 attached to mast 10 with boom clevis 22 pivotally pinned thereto. Mast 10 is normally installed in a matching socket 4 (as seen in FIG. 1) of a boat hull 5 such that mast 10 is perpendicular to the plane of the deck. A boom 20 is disposed in clevis 22 and arranged to be pivotable in a vertical plane from a position essentially at right angles to mast 10 to a position parallel with mast 10 as indicated by the dashed lines. A boom line 28 attached at a point near the outer end of boom 20 serves to thus raise and lower boom 20 with respect to mast 10. Boom line 28 is passed through pulley 33 to boom winch 23 with pulley 33 attached at a point on mast 10 such that winding of boom line 28 on winch 23 will raise boom 20 to an essentially vertical position as is required for storage purposes. As will be explained more fully later, winch 23 is used to adjust boom 20 to a desired operative position. With reference to FIG. 1, it may be seen that boom 20 serves to support sail assembly 40 as described below. Boom 20 is strengthened by spreader 24 and boom stays 26 to prevent bending when supporting sail element 40.

FIG. 3 shows schematically the wing sail and supporting configuration of my invention isolated from the other elements of my sail. The wing sail assembly 40 comprises a yard 30, a fabric or plastic sail surface 41, rigid curved battens 42, and batten rings 43. Rigid battens 43 are firmly affixed to sail surface 41 along its chord with rings 43 at the upper edge. A lateral pocket 57 is formed along the upper edge of sail surface 41 with rings 43 disposed in the pocket 57 as shown in cutaway. Yard 30 is passed through pocket 57 and rings 43 thereby suspending sail surface 41 from yard 30. Sail 40 is suspended at the midpoint of yard 30 by yard line 34 and pulley 36 attached to boom 20 as shown in phantom view and in FIG. 1. Line 34 passes through pulley 35 attached to the top end of mast 10 shown in phantom view, thence to winch 32. Winch 32 is primarily used to hoist or lower sail assembly 40 to a desired position adjacent to boom 20 and is not changed during normal sailing activities. It is desirable to maintain yard 30 approximately perpendicular to boom 20 and to this end, I provide a fixed guy 46 attached to each end of yard 30 with each yard guy 46 secured to swivel 22 near the base of mast 10.

As may now be recognized, my sail 40 when in normal operative position, is suspended from boom 20 at the midpoint of yard 30 and constrained to form a right angle thereto. However, it is to be noted that yard 30 can be rotated laterally with respect to boom 20, and that the lower edges of sail surface 41 are free to swing longitudinally with respect to boom 20.

Referring now to FIG. 4, I show schematically the control system of my novel controllable wing sail, isolated from the other elements of the sail. Basically, two control actions are required. The wing-like sail assembly 40 acts in the nature of an airfoil as a consequence of the rigid cambered battens 42 and it is first necessary to adjust the primary angle of attack of sail 40 with respect to the relative wind for most efficient operation of sail 40. Secondly, it is required to adjust the angular position of yard 30 with respect to the horizon in accordance with the desired heading of the boat relative to the wind direction to obtain maximum efficiency from the wingsail. In addition, the local angle of attack of various portions of the wing must also be varied by a warping adjustment to provide maximum efficiency for a given wind condition and heading of the craft.

For control of the primary angle of attack of sail 40 shown in phantom view, I provide preventer line 49 and sheet lines 44. Preventer line 49 is run through pulley 39 at the outer extremity of boom 20 (shown in phantom view) to pulley 37 at the tip of mast 10 thence to winch 48. Sheet lines 44 are attached to the outer ends of rigid battens 42 and are gathered together at pulley 47 attached at the lower end of boom 20. Lines 44 are taken up on winch 21. The manner in which the angle of attack is adjusted may be seen by the example of FIG. 4 in which winch 21 takes up lines 44 as at F and winch 48 lets out line 49 as at E, maintaining tension between lines 44 and line 49. The result is movement of the lower edge inward thereby increasing the angle of attack. As is to be understood, the winches 21 and 48 may be locked when the desired angle of attack of sail 40 is obtained. Winches 21 and 48 may be combined as a single compound winch in which simultaneous control of lines 44 and line 49 can be provided. In the event the wind is too light to lift sail 40, line 49 can be taken in and lines 44 allowed to be slack thereby providing slow speed sailing.

I have found it advantageous to rotate yard 30 for angular distances up to $\pm$ 80° from horizontal around boom 20 while maintaining a 90° relationship between yard 30 and boom 20 with the amount of rotation selected to produce maximum propulsion efficiency of high-aspect-ratio sail assembly 40. The amount of rotation required is dependent on the desired boat heading and velocity relative to the wind direction. To make this adjustment, yard rotation lines 25 and 26 are provided. These lines compromise a line from each outer end of yard 30 to pulleys 31 mounted near the tip of mast 10 and then to pulley 29 near the base of mast 10. When line 25 is pulled downward as at A, line 26 moves upward as at B. This causes a clockwise rotation of yard 30 as indicated by arrows C and D. Yard 30 is, of course, held at right angles to boom 20 by yard guys 46 as seen in FIG. 3 previously described. A line-locking device 27 may be used when it is desired to operate the yard in a fixed position. In many cases, however, it is desirable to hold lines 25 and 26 in position manually thus allowing frequent trimming as the heading of the boat is varied; locking device 27 is disengaged in such case.

It may be noted that I show four sheet lines 44, each attached to the lower end of a batten 42. Due to the freedom of each batten 42 to pivot around yard 30 by its ring 43, shortening or lengthening of a single sheet line 44 will cause a warping of the sail surface 41. I have found that careful trimming of the sail camber in this manner can result in maximum efficiency of propulsion of the boat in accordance with my invention. Therefore, I advantageously include shortening devices 45 in each sheet line 44 so that the length of each may be independently adjusted to its optimum for any given set of conditions.

Having described in detail the basic elements of my invention, installation of the completely assembled controllable wing sail may be understood with reference to FIG. 1. Mast 10 is inserted in socket 4 on the boat hull 5 and is free to rotate within socket 4. I prefer that the mast 10, boom 20 and yard 30 be constructed of light metal such as aluminum although any suitable material may be used. When metal is used, a securing and grounding ring 60 is attached to the mast 10 after installation. The grounding lead 61 can be attached to a metal-clad center board to serve as lightning protection. The heading of boat 5 is controlled by the position of rudder 7. As the heading is changed, the sail assembly is free to swing around to maintain the desired point of sailing. If desired to have the boat self-steering, such as on long tacks, lines can run from the intersection of boom 20 and yard 30 to the bow or the stern of the boat. The centerboard or other conventional means prevents skidding of the hull through the water; however, advantageously, a heavily-weighted board is not required as is usual with conventional sails since there is no overturning moment due to the wind pressure on the sail.

In addition to the main support and control lines described hereinabove, additional lines can be added when desired. For example, a fixed boom line 38 as shown in FIG. 1 may be added which prevents excessive lowering of boom 20 with respect to mast 10 and assists in bracing boom 20 against deflection. Similarly, additional lines similar to yard guys 46 may be run from rings 43 to the clevis 22 to add to the support of yard 30 which may be particularly advantageous under heavy wind conditions. As may now be understood, the force of the wind in sail 40 is transferred to the hull 5 near the base of mast 10 by boom 20, stays 46, and sheet lines 44, allowing a relatively large sail area to be employed.

It may be recognized that the sail and rigging as shown in FIG. 1 is not necessarily in a correct condition for actual sailing but rather is oriented to show as clearly as possible all of the various elements, components, and adjustments of my invention. FIG. 1A is a view of a sail boat using my sail with the wind off the port bow. For this point of sailing, line 26 is shortened and line 25 lengthened to rotate the forward end of the boom upward and the rearward end downward. This general orientation of yard 30 with respect to the horizon tends to maximize the propulsive force of the wind as will be discussed in more detail hereinbelow.

My novel controllable sail can be recognized as a lightweight air foil fabricated from fabric, plastic, or other flexible, non-stretchable material that is maintained in a cambered configuration by the rigid curved battens 42 thus providing many advantages of a rigid air foil such as proposed in the prior art but without the attendant drawbacks of the solid air foil. The fabric sail 41 thus is not dependent on a wind-created luff to maintain a camber and therefore has a better lift-to-drag ratio for increased propulsion efficiency and is more easily controllable. The stability and controllability of my sail is due in large part to the tetrahedron formed by the support and control elements of my invention and is illustrated schematically in FIG. 5. Side 10' of the tetrahedron is formed by mast 10 attached to the hull. Side 30' is formed by yard 30; sides 46*a'* and 46*b'* are formed by stays 46, and sides 25' and 26' are formed by yard rotation lines 25 and 26. Pressure P on side 30' caused by wind force on the sail 40 maintains tension on the lines thus forming a rigid tetrahedron. As the lengths of sides 25' and 26' are varied as the yard rotation lines 25 and 26 are adjusted, side 30' rotates changing the sizes of included angles A', B', C', and D'.

The operation of my novel controllable wing sail under different points of sailing may be better understood with reference to FIG. 6 which illustrates a craft on various headings with respect to the wind direction. With the craft running before the wind, lines 25 and 26 may be adjusted to be of equal length and yard 30 is perpendicular to mast 10. When it is desired to permit reaching or beating upwind with the wind off the starboard, line 25 is shortened and line 26 is lengthened, tipping the starboard tip of yard 30 downward. Conversely, when the relative wind is from the port side, line 25 is lengthened and line 26 is shortened, dipping the port tip of yard 30.

The orientations of yard 30 for the various points of sailing described above generally provide a near maximum propulsive force and are, of course, controlled by the operator with the optimum position being dependent on the strength of the wind, the exact heading desired, the type of hull, and like factors. For example, theoretically, when running before the wind, as in 6-1, the yard should be parallel with the horizon. However, I have found experimentally that adjusting the yard to a slight angle produces a slightly better "feel" to the motion of the boat.

As may be evident from the examples of FIG. 6 and referring to FIG. 1, the heading of the craft is controlled by the rudder 7 since the complete sail assembly is free to rotate in socket 4 which acts as a bearing. Thus, as the heading is changed, the wind causes such rotation so as to maintain sail 40 essentially facing the relative wind. I have found experimentally that it is advantageous to position socket 4 so as to tip mast 10 slightly forward rather than exactly perpendicular to the hull deck. The tendency in this case is for gravity to swing the sail assembly to point forward under a calm condition. In very light or flukey wind conditions, this configuration provides an element of additional stability since it tends to swing around to the correct attitude without constant attention of the operator.

As mentioned hereinabove, it is important to be able to control the angle of attack of sail 40 with respect to the relative wind so as to optimize the propulsive force of the wind over a wide range of velocities. The primary adjustment is effected by operation of winches 48 and 21 (see FIG. 1). Taking up on winch 48 and letting out on winch 21 reduces the angle of attack and vice versa. When sailing at points other than with the wind, yard 30 is rotated as previously discussed. In such cases, each individual line 44 can be separately adjusted by take-up device 45 associated with the line to slightly change the angle of attack along the span of the sail to satisfy localized airflow and thereby obtain an increase in effectiveness.

Figure 7:
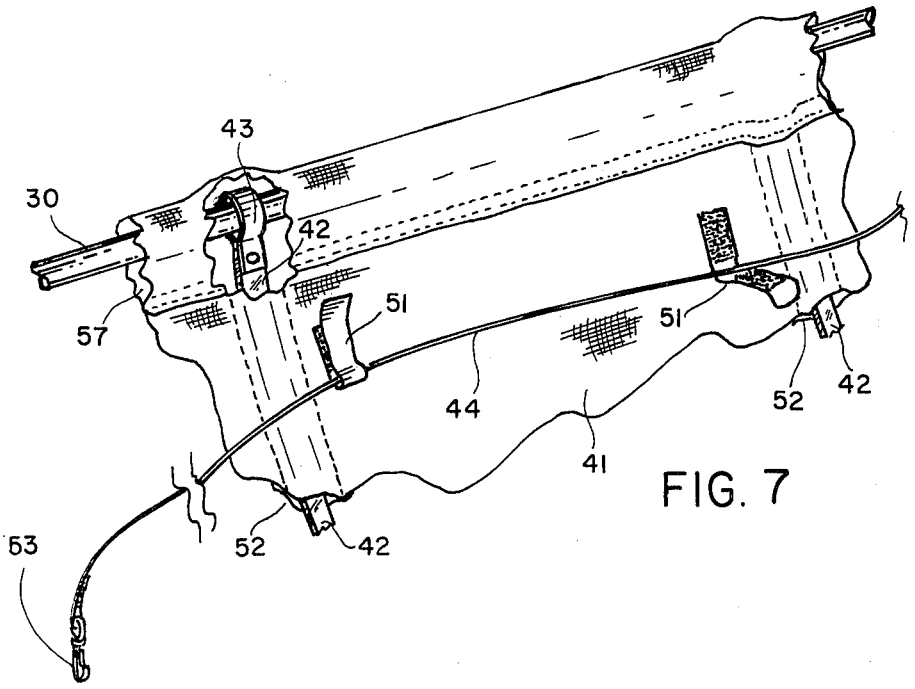
FIG. 7 is a fragmentary view of the sail element of my controllable wing sail showing details of its construction.

Having described in detail the overall construction and operation of the preferred embodiment of my controllable wing sail, I show in FIGS. 7, 8, and 9 certain constructional details that allow convenient lowering and stowage of the sail. A fragmentary view of sail assembly 40 is illustrated in FIG. 7. Sail 41 has its upper edge sewn or otherwise fastened to form pocket 57 extending transversely across the length of the sail. An additional set of pockets 52 are sewn in sail 41 from upper edge to lower edge. A rigid curved rib 42 is inserted in each of pockets 52 with ring 43 attached to one end of rib 42. Ring 43 is disposed in pocket 57, and yard 30 is inserted in pocket 57 and threaded through rings 43 thereby supporting sail 41 in yard 20. Line tabs 51 are useful ancillary devices attached to sail surface 41 and are adapted to temporarily hold lines, such as line 44, when rigging the sail for stowage to prevent fouling and tangling of the lines. Tabs 51 are formed from strips of Velcro material and can be quickly opened to release the lines. Tabs 51 are disposed in a number of spots on the sail, and on the mast and boom assembly.

It is an important feature of my invention that the sail assembly can be easily disassembled, brailed, and stowed. The sail may be used to replace conventional sails on an existing hull to improve its speed, stability, and ease of handling. For example, in experiments with my novel wing sail installed on a conventional displacement hull, the boat attained hull speed on almost all points of sailing. As compared with the same hull fitted with conventional sails of half of the area of my wing sail, the craft pointed better and was completely stable in winds that would have capsized the boat when carrying the conventional sail.

However, the potential of my new sail is best realized with a specially designed hull that will minimize drag. The optimum hull for light winds is a long racing scull; for medium winds, a planing monohull; and, for heavy winds and rough wave conditions, a hydrofoil.

To ensure universal application of my invention, I prefer to use lightweight materials and have configured the assembly to be easily removable and installable and therefore can be used with almost any desired hull. Unlike the masts, yards, and booms utilized for conventional sails, these supporting elements are in tension in my sail assembly during sailing due to the lifting moment caused by the force of the wind. Therefore, light materials such as aluminum and magnesium can advantageously be used.

FIG. 8 illustrates my sail assembly being collapsed for stowage and FIG. 9 shows the assembly ready for stowage. Lines to be disconnected for lowering generally are provided with spring swivel clips 53 as seen in FIG. 7. To lower the sail, boom 20 is raised toward its vertical position with winch 21 and sail assembly 40 is lowered by means of line 34 and line 49 using winches 32 and 48. The various stays and control lines are unclipped from sail assembly 40 and the lines secured in appropriate line tabs 51 to prevent tangling, and by reeling onto the winches. The outer ends of sail 41 are unclipped from the outer ends of yard 30. The slidable rib rings 43 and pocket 57 allow the sail 41 to be brailed by bunching the fabric together at the center of yard 30 as indicated by the arrows. The brailed sail 41 is then wrapped with available lines to secure for stowage, appearing at this point as shown in FIG. 9. The mast 10 is removed from the hull and the various lines associated with mast 10 and boom 20 are appropriately secured by tying off as seen in FIG. 9. I prefer to utilize a plastic or fabric sleeve-like bag 70 of sufficient size to allow the collapsed mast-boom assembly and the brailed sail-yard assembly as shown in FIG. 8 to be inserted for protection during stowage. A draw string 72 is provided for closure of bag 70. As will be obvious to those skilled in the art, variations in construction of the assemblies can be made dependent on the size of sail desired. For example, either telescoping or jointed masts, booms, and yards can be used to reduce the length of the disassembled package.

It may now be appreciated that my novel kite-type wing sail provides a long-sought solution to the problem of propelling a sailing craft at full hull speed for nearly all points of sailing with complete stability and over a full range of wind velocities. My sail is easily installable on existing hulls as well as on hulls specially designed to achieve its full potential of efficiency. As described hereinabove, my support and control means provide positive control of the wing-like sail in three orthogonal angular directions with respect to the relative wind, thus allowing the operator to maximize the propulsive force in the desired direction of travel of the craft and to minimize any overturning moment due to wind forces on the sail.

In the preferred embodiment, I use a vertical mast and a single, angularly adjustable boom to support the wing sail. However, many variations of the support structure will be obvious to those skilled in the art. For example, more than one boom may be used when a very large sail area is desired. Various other materials and methods of construction can be used without departing from the scope and spirit of my invention. While I have discussed my novel controllable wing sail with respect to sailing boats, it is to be understood that it is equally applicable to other craft such as ice boats, sailmobiles, sailing sleds, and the like providing similar advantages in such applications.

I claim:

1. A sail and rigging comprising:

a vertical mast installable on a hull;

at least one boom pivotally attached to said mast at a point near the base of said mast, said boom pivotable in a vertical plane;

a yard disposed near the outer end of said boom and maintained essentially at right angles to said boom;

an essentially rectangular cambered sail having the span of said sail greater in length than the chord of said sail with the upper edge of said span attached to said yard;

boom control means operatively connected to said boom, said boom control means effective to selectively adjust the vertical angle of said boom with respect to said mast;

yard control means operatively connected to said yard, said yard control means effective to selectively adjust the angle of said yard with respect to the horizon;

sail angle control means operatively connected to said sail, said angle control means effective to selectively adjust the angle of attack of said cambered sail with respect to the relative wind;

sail trimming control means operatively connected to said sail, said sail control means effective to selectively control the angle of attack of at least one portion of said sail with respect to other portions of said sail; and rigging means for erecting and lowering said sail, said rigging means operative to maintain said sail when in the erected condition supported in a kite-like fashion and arranged to transfer the force of a wind incident on said sail to the center of effort of the hull whereby said hull is propelled by such force without an overturning moment from the force of the wind on said sail.

2. A sail and rigging arranged to be easily installed on and removed from displacement hulls, planing hulls, hydrofoils and the like, comprising:

an essentially rectangular wing like sail having a span of greater length than its cord, said sail having a yard at least equal in length to said span of said sail, a flexible nonstretchable essentially rectangular sail surface with one span edge affixed to said yard and suspended therefrom, and a plurality of rigid curved ribs arranged in an essentially parallel spaced relationship essentially parallel to and along the chord of said sail surface and affixed thereto whereby said sail surface is maintained in an essentially cambered form, with a first end of each of said ribs pivotally attached to said yard;

support means mountable on a hull for supporting said sail, said support means having an essentially vertical mast for attachment to a hull, a boom having its inner end pivotally attached near the base of said mast and pivotable in a vertical plane, said boom arranged to support said yard at a point near the outer end of said boom and at the approximate center point of said yard, boom line means connected to said boom and to said mast for supporting said boom at a selectable vertical angle with respect to said mast, and yard stays connecting outer ends of said yard to a point near the base of said mast thereby maintaining said yard at essentially right angles to said boom and transferring wind force on said sail to the center of effort of the hull when said mast is attached to a hull;

angle of attack adjustment means, associated with said sail and said support means, said angle of attack adjustment means having line control means attached to said mast including control lines connected to a second end of at least some of said plurality of curved ribs whereby operation of said line control means causes said plane of said sail surface to pivot with respect to said yard thereby adjusting the angle of said plane with respect to an incident wind;

span angle adjustment means associated with said sail and said support means having adjustable yard lines attached to said yard and controllably attached to said mast whereby adjustment of said lines causes said yard to rotate about said boom thereby controlling the angle of said yard and said sail with respect to the horizon plane; and bearing angle adjustment means, including a cylindrical base portion of said mast and bushing means for mounting said base portion on a hull whereby said support means is free to rotate as the heading of the hull is changed thereby controlling the angle of said span of said sail with respect to the direction of hull travel.

3. A sailing craft comprising:

a hull means;

a cambered sail for providing a propulsive force from an incident wind, said cambered sail having a yard, an essentially rectangular flexible sail surface having its span of greater length than its chord, with one edge of said span attached to said yard suspending said sail surface therefrom, and a plurality of rigid curved ribs attached in a parallel spaced relationship essentially parallel to and along the chord of said sail surface, whereby said sail surface is maintained in an essentially cambered form, with a first end of each of said ribs pivotally attached to said yard;

supporting means for mounting said sail on said hull means arranged to transfer the propulsive force provided by said sail to the center of lateral effort of said hull, said supporting means having an essentially vertical mast, said mast rotatably mounted to said hull, a boom pivotably attached near the base of said mast, said boom pivotable in a vertical plane, means for selectively positioning said boom in a vertical plane, said boom arranged to support said yard near the outer end of said boom, fixed stays connecting the outer ends of said yard to the base of said mast for maintaining said yard at essentially right angles to said boom and for transferring the propulsive force to the center of lateral effort of said hull; and control means connected to said supporting means and to said sail, said control means comprising winch and winch line means, said winch means attached to said mast and said winch line means connected to a second end of at least some of said ribs whereby operation of said winch means causes said sail surface to pivot about said yard thereby changing the angle of attack of said sail with respect to the relative wind, and adjustable yard lines attached to each end of said yard and arranged to laterally rotate said yard about said boom whereby adjustment of said yard lines provides control angle of said yard with respect to the horizon.

* * * * *